United States Patent [19]

Langston et al.

[11] 4,261,746

[45] Apr. 14, 1981

[54] FLUX

[75] Inventors: Benny Langston, Barrington; Niranjan M. Parikh, Winnetka; Ronald E. Beese, Barrington; Carl F. Bauer, Chicago, all of Ill.

[73] Assignee: American Can Company, Greenwich, Conn.

[21] Appl. No.: 89,480

[22] Filed: Oct. 30, 1979

[51] Int. Cl.[3] ..... C22B 9/10

[52] U.S. Cl. ..... 75/257

[58] Field of Search ..... 75/257, 68 R

[56] References Cited

U.S. PATENT DOCUMENTS 3,754,897 8/1973 Derham ..... 75/68 R

*Primary Examiner*—P. D. Rosenberg

*Attorney, Agent, or Firm*—Robert P. Auber; Stuart S. Bowie; Aaron Passman

[57] ABSTRACT

This invention pertains to fluxes used in recovery operations for secondary aluminum. The flux herein is formulated in order to minimize the amount of chloride in the slag whereby it can be used as land fill without an adverse impact on the environment or in lieu of bauxite in the manufacture of aluminum or as source of aluminum oxide for the manufacture of aluminum or aluminum salts. The flux uses a combination of sodium chloride and aluminum chloride which form a double salt having vapor pressure sufficiently low to permit the aluminum chloride sublimation, without rapid sublimation, however, sufficiently high to permit the evaporation of chloride salts to provide low chloride slag. The improved flux also permits the heat cycle to be shortened by 10 to 20 percent thereby giving a measurable energy savings.

8 Claims, 1 Drawing Figure

FLUX

BACKGROUND OF THE INVENTION

The processing of aluminum by melting is divided into the primary and secondary industries; the former having to do with the processing or remelting aluminum for production of new ingots in which selected mill scrap, purchased scrap and pure metal with alloy additions are used. In primary remelting no fluxes are used to assure clean ingot. The term fluxing in the primary industry applies to the degassing and cleaning of molten aluminum prior to pouring into ingot. The secondary industry is essentially concerned with aluminum from slag, dross and scrap of a variety of origins generally unknown. Consequently, the constituents used in charging secondary recovery furnaces contain impurities and oxides which must be separated during the melting processing in order to segregate the valuable metal. It is important to have a flux which separates the metal from the scrap which include a variety of dross, slag, recycled scrap, discarded cans and containers, salvaged castings and the like. Because of the nature of some of the scrap including its impurities, oxides and size of individual pieces, it becomes necessary to employ salt fluxes to minimize oxidation and improve slag formation during melting and thereby enhance the recovery rate of the valuable metal.

The oxides encountered in the reverberatory furnaces of the secondary aluminum recovery industry necessitates fluxes to assist in collection of dross and removal of inclusions and gases. Such fluxes are generally mixtures of sodium and potassium chlorides. Fumes and residues from these fluxes and the treatment of dross are problems of environmental and economic importance and efforts are constantly being made to improve the reclamation of the flux and the metal in the dross. The primary components of the dross are flux residues, a plurality of aluminum oxides and hydrated aluminum oxides and entrained metallic aluminum plus small amounts of magnesium chloride, aluminum carbide, aluminum nitride and small percentages of calcium, silicon, magnesium, iron, zinc and manganese. The charge to secondary aluminum furnaces, either rotary or reverberatory, is treated with fluxes of sodium chloride and potassium chloride in order to recover the metal values.

After remelting and skimming the molten metal is treated to remove dissolved hydrogen, inclusions and undesirable trace elements such as sodium. This is accomplished by bubbling chlorine or a mixture of chlorine and nitrogen through the molten metal via graphite tubes. In large scale operations, in line filtering and fluxing systems between the holding furnace and the cast station are similarly used to reduce hydrogen, inclusion contents and undesirable trace elements. These processes have a beneficial effect in that fume generation and air pollution are minimized.

Normally, the flux salts used in reverberatory furnaces during secondary aluminum recovery operations are a eutectic combination of potassium chloride and sodium chloride each of which can be usually be between 30% and 100% of the oxides in the charge. To this eutectic combination is added cryolite, it being sodium aluminum hexafluoride or other such fluoride salts. The flux retards the oxidation of the molten aluminum and tends to separate the oxides from the surface of the aluminum during melting whereby small globules of aluminum coalesce becoming heavier and sink into the molten aluminum bath. The flux and oxides float atop the molten aluminum bath forming a removable slag. Such slag generally contain a high content of chloride salts which make them environmentally deleterious and prevents their use as land fill or the like. This high chloride slag contains about 30 to 50% salt, 9 to 35% aluminum and the balance oxides.

The fluxes used in secondary aluminum practice have been adapted largely as a result of the process of "cut and try", but little scientific experimentation has been done. Certain flux compositions have been used for years, not because they have any special merits, but rather because of tradition. The actual composition used although not published have become more or less known.

Literature about fluxes for use in melting secondary aluminum is scant and of little value, that dealing with the thermal equilibria of metallic salt flux systems is highly contradictory. Knowledge of fluxes is, in fact, almost wholly empirical. The intelligent use of a flux requires detailed knowledge of the chemical and physical relationships between metal and flux, foreign matter and flux, and metal and foreign matter at various temperatures. Flux may be classified as:

Those which are used principally as liquid covers to prevent oxidation, those which dissolve aluminum oxide and hence promote coalescence, i.e. the so-called chemical fluxes;

those which are volatile or dissociate at or below normal melting temperatures and which effect separation of dross largely by mechanical action, and those which are strong oxidizing agents and are used in certain "refining" processes.

A flux cover consists of metallic salt mixtures thereof which are liquid at the melting temperature and have lower density than liquid aluminum. Their function is made to protect the metal being melted from contact with the furnace atmosphere. As used in practice, they overlie the bath of metal and serve to prevent, or at least considerably reduce oxidation. If of the proper composition, a flux cover may act like a metallurgical slag and dissolve oxides and other impurities from the bath of metal. This action may not be pronounced unless the cover is worked down into the metal by rabbling, because otherwise the flux contacts only the surface of the metal. A flux cover is generally used in melting finely divided scraps in stationary-hearth furnaces. Sodium chloride is the basis of a common flux cover employed to prevent oxidation. This salt evidently has no direct solvent action on oxide and dirt. The melting point may be lowered by suitable admixture of other salts which have some solvent action.

Various binary and more complex mixture salts have been used as liquid covers in secondary practice. The composition of the cover can dissolve aluminum oxide and dirt but can have a little solvent action. The usual covers are mixtures rich in sodium chloride or calcium chloride, the latter not as desirable since it is deliquescent. If the cover is to have considerable solvent action for aluminum oxides will contain a percentage of a fluoride. Solubility of oxide by a cover is promoted by the presence of cryolite and more especially cryolite and aluminum fluoride in certain proportions. The choice of a suitable fluxing cover is governed by the melting point, density, cost, whether active fluorides are to be present, and other factors. The density of the flux, if it is to be used as a liquid cover, should be substantially less than that of aluminum so that it will readily float and small particles which become suspended in the bath of metal will freely rise.

Various mixtures of the halogen compounds of the alkali and alkaline earth metals are used as chemical fluxes. Fluxes which dissolve aluminum oxides by chemical action contain fluoride salts which dissolve aluminum oxide. The known active metallic-salt solvents for aluminum oxide are fluorides and double fluorides. The situation with regard to the action of chlorides is not clear. They apparently do not have solvent effect but have some physical action which is not understood.

Most liquid-flux cover as practiced has some chemical power for dissolving oxide and dirt, and the common chemical fluxes dissociate or interact with aluminum, thereby generating gasses or slag into the melt and a stirring action in a bath. It is, of course, apparent that a chemical flux would be of little use if its reacting temperature were far above the melting point of aluminum. A volatile flux has some chemical action because they volatilize or dissociate at or below ordinary aluminum melting temperatures, and fluxing action is largely mechanical. The two volatile fluxes which have been used most in aluminum work are ammonium chloride and zinc chloride. The commonly used salts which are generally classed as volatile fluxes include aluminum chloride, ammonium chloride, magnesium chloride, sodium silicofluoride, and zinc chloride. These substances are used mainly in fluxing melts and have also been employed in the dry (pasty) process of remelting finely divided scrap. The salts either volatilize at or below the melt temperature or decompose (or interact with aluminum) so the volatile substances are evolved. They give considerable mechanical stirring action to a bath of metal. When added to the surface of melt they have the effect of detaching the metal from admixed oxides and dirt, yielding a dry powdery dross. In fluxing melts, ordinarily only a few ounces of the salts are used per 100 lb. of metal. In the pastry process of melting borings, 1 to 2 percent by weight of the fluxes may be mixed with the scrap.

The dissolution of aluminum oxide, dirt, or other coating on globules of liquid metal is a necessary attribute of a flux. Coalescence of globules cannot take place unless the coating is ruptured. It would appear that the coating might be more easily and thoroughly removed by chemical means than mechanically. The power of reducing the surface tension of metal globules is generally regarded as an important attribute of a melting flux. Coalescence is promoted by the reduction of surface tension, i.e., the fluidity is increased.

The chemical action of fluxes in aluminum melting is not well understood. Much of the action which takes place appears to be of physical nature. The chemistry of deoxidation is of little use in studying the fluxing of aluminum because the reduction of the oxide does not take place. Aside from solution effects and the direct interaction of fluoride compounds whatever chemical action directly takes place is evidently between the metal and the flux rather than between the oxide or included matter and the flux. While there may be chemical interaction of fluorine, liberated from fluoride fluxes, or of a fluoride compound itself, with aluminum oxide, the chief value of chemical fluxes appears to lie in their power of dissolving the oxide.

Aluminum chloride has been used with satisfactory results as a flux. While fluoride fluxes may have a direct chemical action on oxide, there is some question as to a presumed chemical action of chlorides. The usual explanation given of the action of chlorides on oxides in fluxing is that the chloride interacts with the oxide, forming new chlorides and new oxides, the chlorides being volatilized and the oxides rising to the surface of the bath.

The question of surface chemistry is generally regarded as important in considering the action of fluxes. It is generally held that a fluoride should reduce the surface tension of liquid-metal globules, but true surface tension effects are masked by the presence of the oxide envelope. Two clean globules of liquid aluminum will readily coalesce when contact is made, regardless of surface tension. An analogy may be drawn by picturing two soap bubbles filled with air. The air (analogous to liquid aluminum) is mobile and fluid but cannot escape the imprisoning wall until the bubble (oxide film) is broken but rather more importantly than the modification of the surface tension of liquid globules is the alteration of the interfacial tension between the globules and oxide coating or globules and fluxes.

In aluminum-scrap melting, when small liquid globules are in intimate contact with flux, it would appear that their coalescence may be promoted by increasing the tension aside from dissolution of the oxide envelopes. In the use of chloride salts in fluxing baths of aluminum, it has often been observed that the physical changes which occur seem to be out of proportion to the amount of flux used, or rather out of proportion to any chemical reaction which might be set up by a small amount of flux.

In the patent art L. J. Derham et al., U.S. Pat. No. 3,754,897 teaches that sodium aluminum chloride ($NaCl_4$) plus a small excess of sodium chloride (NaCl) mixed with aluminum furnace dross in equal molar parts and if heated to 750° C. will separate 70 to 85% molten aluminum from the dross. The Derham flux is a non-volatile flux; he reports that a mixture of $NaAlCl_4$ and 2% by weight NaCl melts at 650° C. while $NaAlCl_4$ melts at 151° C.

L. J. Derham et al. in his U.S. Pat. No. 3,650,730 also teaches that flux composed of 50% NaCl, 45% KCl and 5% cryolite ($Na_3AlF_6$) will readily combine with $AlCl_3$ formed during the chlorination of secondary aluminum melts to remove magnesium, hydrogen and other impurities. The dissolved $AlCl_3$ also reacts with magnesium thus reducing the quantity of chlorine gas necessary to purify aluminum. This Derham process is currently employed by some secondary aluminum processors, however, the teachings of this process are outside the scope of our invention.

The present invention provides a method, compositions and articles for the direct recovery of metallic constituents which are entrained in scrap materials used as feed stock to molten metal baths in such a way as to provide a residue or slag material on the surface of the molten metal bath which contains particularly low levels of deleterious metal halide salts and significantly reduced levels of metallic constituents so as to provide a slag consisting almost entirely of inert metal oxides and other inert material which can be safely and conveniently disposed. Furthermore, the present invention accomplishes these desirable features in such a way as to overcome the disadvantages of the methods of the prior art.

While the invention is widely applicable to the recovery of any metal mixture of scrap materials which is charged to molten metal baths it is especially useful for the recovery of metal values entrained in drosses, skims, slags and other secondary scraps of unknown origins as processed in the secondary aluminum industry. It is understood, however, that the particular species described is equally applicable to the processing of individual types of aluminum scrap and even other metallic scraps and indeed is generally applicable to the recovery of aluminum, zinc, copper, tin, lead, etc., generally entrained in scrap mixtures of unknown origin.

The improvement herein seeks to minimize the amount of flux in the slag by use of a particular flux composition which helps to stabilize volatilization of the principle component of the flux ($AlCl_3$) in a controlled manner thereby slowly removing it from the process. The chemical nature of the flux permits use of less for metal recovery and thus reduces the amount of flux remaining in the slag. $NaAlCl_4$ plus $AlCl_3$ provides a volatile flux which can be used at very low concentrations to separate aluminum from dross or aluminum oxides or aluminum scrap. The difference between the two fluxes with respect to melting point and presumed volatility is readily noted on a $NaCl$-$AlCl_3$ phase diagram.

SUMMARY OF THE INVENTION

The improved flux of the present invention is composed of the above salts and provides the proper quantity of each salt so that a double salt is formed when the flux contacts hot scrap materials of the molten metal bath. It is important that a sufficient excess of $AlCl_3$ remain to slowly vaporize from the surface of the scrap material. A preferred mixture of the above salts has been found to be 2 moles of $AlCl_3$ to one mole of NaCl. Further, for the sake of simplicity, it is preferred to use this flux alone, but increased additions of the $AlCl_3$ salt have been found to provide improvement in the amount of metal recovered from scrap materials. The amount of excess $AlCl_3$ provided above the minimal mixtures of the salts necessary to produce the double salt also depends on economical considerations.

In addition, although the prescribed mixture of salts specified in the preferred embodiment is 2 moles of $AlCl_3$ to one mole of NaCl, this mixture can be used as well admixed with other fluxes, such as cryolite ($Na_3AlF_6$) type. However, mixed fluxes of this type result in generally raising the melting point of the flux and further reducing the vaporization of the excess $AlCl_3$ in the flux misture. Thus, although the admixture of cryolite in small concentrations ranging from 1 to 5% by weight to the amount of oxides contained in the scrap has been observed to improve the recovery of metal. Quantities of cryolite in excess of this concentration when admixed with the preferred flux mixture may be uneconomical. The aluminum chloride in combination with the sodium chloride with or without cryolite permits the successful use of this flux at approximately one-tenth the concentration of chloride as normally used and thereby generates a slag having substantially less chloride. Cryolite additions to the aluminum chloride, sodium aluminum chloride, double salt flux enhance aluminum recovery. It is further believed that the aluminum chloride enhances the ability of the chloride to vaporize and escape from the slag after same is formed atop the surface of the molten aluminum bath. It is an advantage in using this flux in that the flux enhances and speeds up slag formation thereby providing a shorter heat cycle. In addition, the slag formed is a less percentage of the bath than with the usual fluxes and is composed of 80 to 90% and the balance metal.

DETAILED DESCRIPTION OF THE DRAWING

Figure 1:
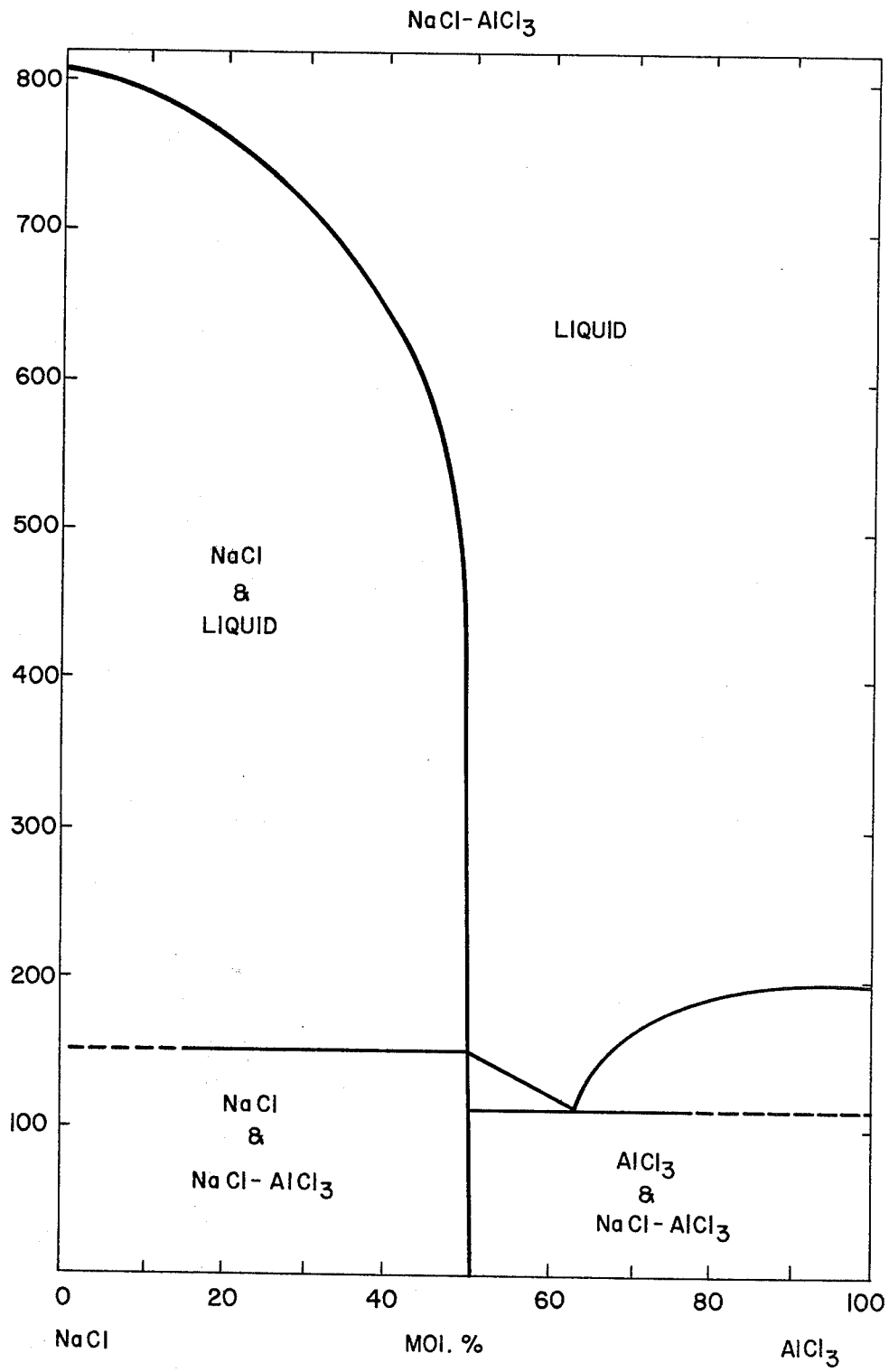
FIG. 1 is a phase diagram for the salt combinations of NaCl and $AlCl_3$ in varying concentrations and at varying temperatures.

The specific details regarding the proper composition of the preferred flux mixture can be gained by reference to FIG. 1 which shows the phase diagram of the binary mixture of NaCl and $AlCl_3$. Starting from the left corner of FIG. 1 the diagram represents pure sodium chloride. Moving horizontally to the right along the abscissa shows the effect on the melting point of increasing additions of $AlCl_3$. It is observed that at the ratio of 50 mole percent a specific composition of the mixture of NaCl and $AlCl_3$ can be identified, this composition which can be produced by adding three parts by weight of NaCl to 7 parts by weight of $AlCl_3$, is known as the double salt. Moving further to the right on the abscissa of the diagram shown in FIG. 1, from the point at which the double salt is produced results in a mixture of the double salt with an excess of the $AlCl_3$. For example, providing 8 parts by weight of $AlCl_3$ and adding 2 parts by weight of NaCl and heating this mixture to approximately 100° C. would result in a product containing one part of the double salt $NaAlCl_4$ and an excess of one mole of $AlCl_3$.

This invention is further understood by reference to the following examples:

EXAMPLE 1

Recovery of aluminum from scrap using preferred flux mix at an appropriate concentration of 3% of the oxides in 90 pounds of scrap aluminum as follows:

| | |
|---|---|
| −3 mesh skims | 31 lbs |
| Borings | 15 lbs |
| sheet scrap | 44 lbs |
| Total | 90 lbs |

These scraps were charged to a gas fired crucible furnace operating at approximately 760° C. which was provided with a weighed molten metal bath (heel) of aluminum of 195 lbs. After adding the scrap mixture to the molten heat a quantity (0.72 lbs) of the preferred 2 moles $AlCl_3$ to 1 mole NaCl mixture of flux was added to the crucible and the mixture was stirred occasionally with a steel rabble. Once the scrap mixture had completely melted the slag was removed from the top and all the metal remaining in the crucible was removed with the final results as follows:

| | |
|---|---|
| Quantities Used | |
| Molten heel | 195 lbs |
| Scrap change | 90 lbs |
| metal in scrap mix | 69.3 lbs |
| Dirt and oxides in scrap mix | 20.7 lbs |
| Flux used | 0.62 lbs |
| Quantities of material removed | |
| Al metal ingot | 244 lbs |
| Slag | 43.8 lbs |
| Chlorides in slag | 3.2% |

-continued

| | |
|---|---|
| Metal recovered | 92% |

EXAMPLE 2

Recovery of aluminum from scrap using the preferred flux mixture of an approximate concentration of 5% of oxides in 87 lbs of scrap aluminum materials are as follows:

| | | |
|---|---|---|
| −3 mesh skims | | 32 lbs |
| Borings | | 14 lbs |
| Sheet scrap | | 41 lbs |
| | Total | 87 lbs |

These scraps were charged to a gas fired crucible furnace operating at approximately 760° C. which was provided with a weighed molten metal heel of 193 lbs. After adding the scrap to the molten heel a quantity (1.04 lbs) of the preferred 2 mole $AlCl_3$ to 1 mole NaCl mixture of flux was added to the crucible and the mixture was stirred occasionally with a steel rabble. Once the scrap mixture had completely melted, the slag was removed from the surface of the molten metal and all the metal remaining was removed with the final results as follows:

| | |
|---|---|
| Quantities used: | |
| Molten bath: | 193 lbs |
| Scrap change | 87 lbs |
| Metal in scrap mix | 66.2 lbs |
| Dirt and oxides in Scrap Mix | 20.8 lbs |
| Flux used | 1.04 lbs |
| Quantities of materials removed | |
| Al ingot metal | 242.0 lbs |
| Slag | 42.6 |
| Chlorides in slag | 3.4% |
| Metal recovered: | 93.4% |

EXAMPLE 3

Recovery of aluminum from scrap using the preferred flux mix (at 3% of oxides in scrap) with an equal quantity of cryolite.

An experiment was performed using cryolite at 3% by weight of oxides and approximately 76 lbs of scrap aluminum materials as follows:

| | | |
|---|---|---|
| −3 mesh skims | | 35 lbs |
| Borings | | 25 lbs |
| Sheet scrap | | 16 lbs |
| | Total | 76 lbs |

These scraps were charged to a gas fired crucible furnace operating at approximately 760° C. A molten metal heel of approximately 185 lbs was also added to the crucible. The preferred flux mixture was added to the crucible in a quantity of 0.47 lbs and in addition 0.47 lbs of cryolite was added to the crucible. Once the scrap mixture had melted all materials were removed from the crucible with the following results:

| | |
|---|---|
| Quantities used: | |
| Molten heel | 185 lbs |
| Scrap charge | 76 lbs |
| Metal in scrap mix | 60.3 |
| Dirt and oxides in scrap mix | 15.7 |
| Flux used | 0.47 lbs |
| Cryolite used | 0.47 lbs |
| Quantities recovered | |
| Al ingot metal | 240.5 |
| Slag | 23.9 |
| Chlorides in slag | 2.9% |
| Metal Recovered: | 98% |

While the invention has been described above in conjunction with a preferred embodiment, it is understood that those skilled in the art will appreciate the mechanism and method sought to be protected as being the action and use of a double salt in combination with aluminum chloride. Consequently, the claims which follow are intended to cover the concept in its broadest context.

What is claimed is:

1. A composition for use in separation of metal values from scrap mixtures of aluminum materials the improvement wherein the metal flux consists essentially of the double salt of sodium chloride and aluminum chloride in combination with an excess of aluminum chloride which occurs when the mol percent of said aluminum chloride is such that free aluminum chloride is present as a vapor part of the flux solution to physically stir and react with the slag when said flux is in contact with the molten metal slag surface in the furnace.

2. A composition for use in separation of metal values from scrap mixtures of aluminum materials the improvement wherein the metal flux consists essentially of the double salt of alkali metal chloride and aluminum chloride in combination with an excess of aluminum chloride which occurs when the mol percent of aluminum chloride is such that free aluminum chloride is present as a vapor part of the flux solution to physically stir and react with the slag when in contact with the molten metal slag surface in the furnace.

3. The composition of either claims 1 or 2 wherein said double salt is a mixture of more than one mole of aluminum chloride in combination with one mole of double salt, sodium aluminum chloride, $NaAlCl_4$.

4. The composition of either claims 1 or 2 reacting at the temperature of the molten metal heel to form a double salt and an excess quantity of aluminum chloride.

5. The composition of claim 1 wherein the vaporization of said metal chloride salts in the flux is used to reduce the amount of chloride in the slag from the furnace.

6. The composition of claim 5 wherein said chloride remaining in said slag is less than 5% of the weight thereof.

7. The composition of either claims 1 or 2 wherein said scrap materials are processed with a concentration of said composition no greater than 15% by weight of the oxides in said materials.

8. The composition of either claims 1 or 2 wherein an alkali metal fluoride combined with aluminum fluoride is used at a concentration substantially equal to the concentrations of said flux.

* * * * *